US005423279A

United States Patent [19]

Long

[11] Patent Number: 5,423,279

[45] Date of Patent: Jun. 13, 1995

[54] PROTECTIVE MAT FOR A PERSONAL WATERCRAFT

[76] Inventor: Anthony J. Long, 951 Duckbill Ave., Las Vegas, Nev. 89123

[21] Appl. No.: 134,308

[22] Filed: Oct. 12, 1993

[51] Int. Cl.[6] ..... B63B 9/00

[52] U.S. Cl. ..... 114/343; 440/38

[58] Field of Search ..... 114/270, 343, 221 R; 440/38, 88, 89

[56] References Cited

U.S. PATENT DOCUMENTS 5,007,870 4/1991 Okubo et al. ..... 114/270
5,036,789 8/1991 Kelly et al. ..... 114/270
5,096,446 3/1992 Tazaki et al. ..... 114/270
5,173,346 12/1992 Middleton ..... 114/229

OTHER PUBLICATIONS

Marine Supply Company, Let's Go Boating 1988, p. 119, Collingswood, N.J.

*Primary Examiner*—Stephen P. Avila
*Attorney, Agent, or Firm*—Quirk & Tratos

[57] ABSTRACT

A mat for replacing the neoprene strips inside of a Jet-Ski ® hull is described. The mat has risers which function to lift the fuel tank above the surface of the inner hull, thereby protecting the fuel tank from possible rupture during use.

6 Claims, 4 Drawing Sheets

PROTECTIVE MAT FOR A PERSONAL WATERCRAFT

BACKGROUND OF THE INVENTION

Numerous water sports are available to the public for recreational fun and enjoyment. A number of these sports involve the motorized propulsion of a vessel across a body of water. For creating a sense of sheer exhilaration, along with a "oneness" with the water, there is little that can compare with a ride on a personal water craft, such as the type manufactured by Kawasaki under the name JetSki ®. Typically used by one rider, a personal watercraft such as a JetSki ® is the nautical equivalent of a snowmobile. Of a similar size and shape, instead of the snow-track the JetSki ® utilizes a waterjet form of propulsion, whereby the motor operates a water pump that is used to create a directional jet of water.

Normally used by one rider, by varying the speed and direction of the waterjet, the rider can exert great control over the direction of JetSki ® movement, and in fact part of the pleasure of riding a JetSki ® relates to its maneuverability. The rider may either stand or kneel while being propelled over the water, and if the rider accidentally falls off of the JetSki ® during a ride, the JetSki ® has been designed to automatically make circular turns until the rider remounts the JetSki ®.

As the sport of Hydrocross has increased in popularity, many riders have modified their JetSki ® to enhance its performance. For instance, high performance engines and exhaust systems are being used to augment the factory-provided systems.

The original Kawasaki ® brand JetSki ® was the Model 440. The new models are denoted the 550, 550SX, 650SX, 650X2, and 750SX, with the Kawasaki brand JetSki ® 750 being the most powerful. As more users have modified their engines, it has become increasingly important to have access to the engine compartment, as well as the motor, exhaust system, water box, and the fuel tank stored therein.

Typically located between the bow and the rider, the engine compartment in the Kawasaki Models 440, 550, and 550SX, places the water box and fuel tank on the floor, resting upon pairs of neoprene strips adhesively-attached to the inner-hull. As one might imagine, the JetSki ® must be able to withstand rough rides, and the water box and fuel tank are held down by rubber straps. Attached to the inside hull of the JetSki ®, the straps force the water box and fuel tank downward onto the neoprene strips.

Unfortunately, over a period of time during use, fuel and oil are spilled within the hull, causing these neoprene strips to become unglued from the inner surface of the hull. With the strips sliding around loose inside the engine compartment, the rider is presented with some problems. The hard surface of the water box or fuel tank and the sheet molded compound (SMC) hull of the JetSki ® hull create a lot of noise when repeatedly brought together as the JetSki ® bounces through the water. In addition, once the neoprene strips work loose, the fuel tank is more likely to rupture upon impact from waves, flotsam or submerged obstacles, as the tank rattles loosely within the engine compartment.

The Kawasaki ® Model 750SX lacks the neoprene strip, with the fuel tank instead resting upon a piece of form-fitted styrofoam. Unfortunately, the styrofoam is quite thick, which in turn makes it difficult for the owner of the JetSki ® to easily modify the pipes or equipment in the inner chamber of the engine compartment. This can be a serious disadvantage, since JetSki ® owners, like the owners of other motorized recreational vehicles, are often seeking the various promised benefits to be obtained by customized engines and other horsepower-enhancing modifications. Additionally, racing fuel has been known to melt down the 750SX styrofoam, resulting in a loss of inner hull protection. Another disadvantage of the 750SX styrofoam insert is the increase in air volume it provides, lifting the JetSki ® center of gravity further above the water line.

For reasons such as the foregoing, there exists a need for a product that can protect the gas tank and water box from impact damage as they ride against the inner surface of the JetSki ® hull, while still providing room to allow modification of components in the engine compartment. There also exists a need for a product that can increase the volume of air in the 750SX JetSki ® engine compartment.

SUMMARY OF THE INVENTION

The present invention is a flexible protective mat for use with Kawasaki ® brand JetSkis ®. The mat is designed to rest on the bottom, inner surface of the engine compartment, fitting between the fuel tank and water box, and the sheet molded plastic JetSki ® hull. The mat substantially conforms to the bottom surface of the engine compartment and protects the fuel tank from contacting the hard plastic surface during use. By virtue of the puncture resistance of the present invention, the fuel tank and water box are protected from impacts caused by various underwater hazards, such as floating debris, submerged tree stumps, and the like, which might otherwise puncture the JetSki ® hull and damage components in the engine compartment.

The design of the protective mat of the present invention is such that it provides a means for replacing the two pairs of rectangular neoprene strips normally adhered to the inner surface of the engine compartment in the Kawasaki ® brand JetSki ® Model Nos. 440, 550, and 550SX. Advantageously, the protective mat of the present invention is made of a flexible, resilient material, and simply rests on, and conforms to, the plastic inner surface of the engine compartment. The protective JetSki ® mat is preferably designed with cutaway portions at the positions where mounting brackets attach to the inner hull surface. In addition, the protective mat of the present invention also has spacer inserts on the right and left edges of the mat that act to lift and suspend the protective mat and the fuel tank above the very bottom surface of the engine compartment.

Although in the presently-preferred embodiment, the mat of the present invention is made from a resilient polymeric resin known as KOROSEAL (RJF International Corp.), virtually any flexible and water-insoluble material is within the scope of the present invention. Other materials such as neoprene, foam, silicon, nitryl or other well-known flexible plastics may be used to produce the protective mat. Advantageous mat materials are those that can withstand contact by oil, gasoline, and salt or fresh water without becoming brittle or otherwise structurally degraded. Other advantages of the mat material are provided by its puncture resilience. With the mat installed, the inner hull is protected from excessive wear by the fuel tank and water box. Additionally, the interior hull is protected from sharp objects that may be protruding out of the water by the mat of the present invention.

The protective mat of the present invention provides a distinct advantage over the stock neoprene strips installed by the manufacturer in the Kawasaki Model Nos. 440, 550, and 550SX model JetSkis®. Since the mat of the present invention does not need to be glued down, yet still covers the SMC inner surface of the engine compartment, it provides much better protection against possible ruptures of the fuel tank and water box due to impact of the JetSki® against underwater hazards. The mat advantageously also suppresses noise and rattling during operation of the JetSki®. In contrast, the stock neoprene strips would frequently become unglued from the bottom and thereafter not protect the water box or fuel tank from contact with the SMC bottom surface of the engine compartment. Not only did such contact enhance the risk of a fuel tank rupture, the rattling of the fuel tank and/or water box were free to rattle against the hard surface of the inner plastic hull of the JetSki®, creating a constant, irritating noise that is greatly disturbing to a JetSki® rider. Further, extended contact between the fuel tank or water box and the inner hull can lead to damaging wear of the inner hull surface. This type of wearing can weaken and eventually cause cracking of the inner hullo In addition, it has become increasingly popular to modify the engine and pipe design of the JetSki® to increase performance. As the protective mat of the present invention covers the majority of the inner hull surface of the engine compartment, and can rapidly be removed and inserted, it provides more protection for modified JetSkis® than the glued stock neoprene strips. The ability to rapidly remove the mat of the present invention also allows easy cleaning of the inner surface of the JetSki® hull, along with a quick method for repairing hull damage.

Along these same lines, the flexible mat of the present invention provides an advantage over the thick, stiff styrofoam covering that is fitted into the interior surface of the Kawasaki Model 750SX engine compartment floor. One of ordinary skill in the art will recognize the advantages to replacing the stiff styrofoam with a thinner resilient protective mat such as disclosed herein.

The flexible mat of the present invention is made of a thinner, more durable material than styrofoam, preferably less than one inch in thickness, and most preferably between 0.25 inches and 0.5 inches in thickness. Being strong yet thin, flexible material of the present invention provides a more advantageous protective mat than the styrofoam material of the Kawasaki Model 750SX, including an ability to be rapidly removed. Also, unlike the thick styrofoam material precisely fitted inside of the Kawasaki Model 750SX, the protective mat of the present invention provides sufficient room in the engine compartment for modifications to the engine or exhaust system. As can be appreciated, numerous JetSki® enthusiasts require the flexibility of being able to modify their JetSki® to obtain maximum performance. In addition, the center of gravity in a JetSki® 750SX can be lowered 1.25 inches by replacing the styrofoam insert with the mat of the present invention.

Various other objects, advantages, and features of the present invention will become readily apparent from the ensuing detailed description, and the novel features will be particularly pointed out in the appended claims.

DETAILED DESCRIPTION OF THE PREFERRED EMBODIMENT

Figure 1:
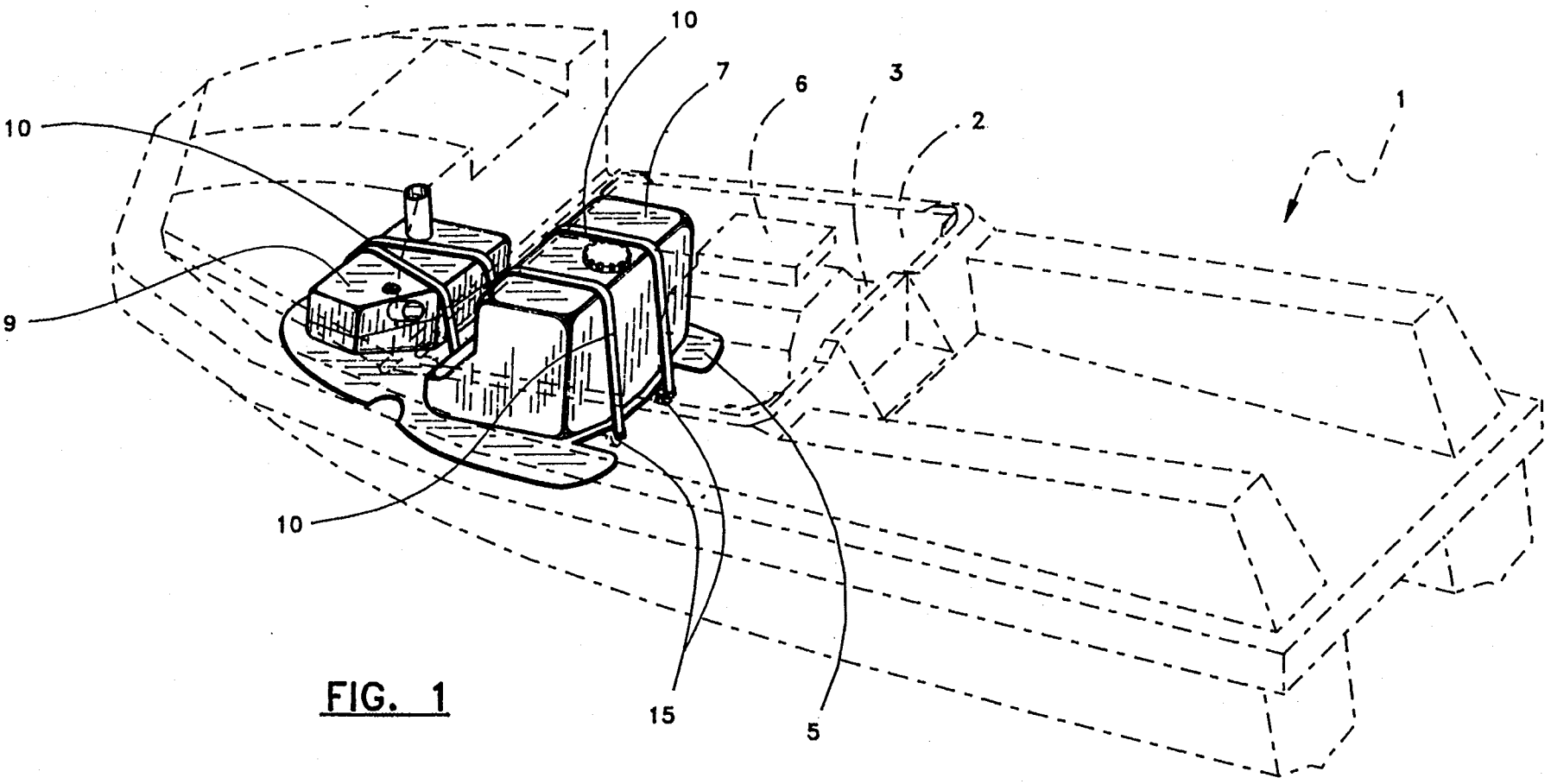
FIG. 1 is a perspective view of a Kawasaki Model 550 JetSki®, with portions in phantom, showing the arrangement of the water box, fuel tank, and protective mat within the engine compartment in accordance with the present invention.

As shown in FIG. 1, a Kawasaki Model 550 JetSki® 1 is shown having a forward engine compartment 2 with a bottom surface 3. A protective mat 5 rests on, and substantially covers the bottom surface 3 of the JetSki® engine compartment 2. In addition to supporting an engine 6 (shown in phantom), the bottom surface 3 of the engine compartment 2 supports a fuel tank 7 and a water box 9, which functions as a reservoir for the water for reducing engine noise. A plurality of rubber straps 10 attached to a plurality of centrally-located mounting brackets 15 (only two are shown in FIGS. 1 and 2) are used to secure the fuel tank 7 and the water box 9 in position on top of the mat 5 within the engine compartment 2.

Figure 2:
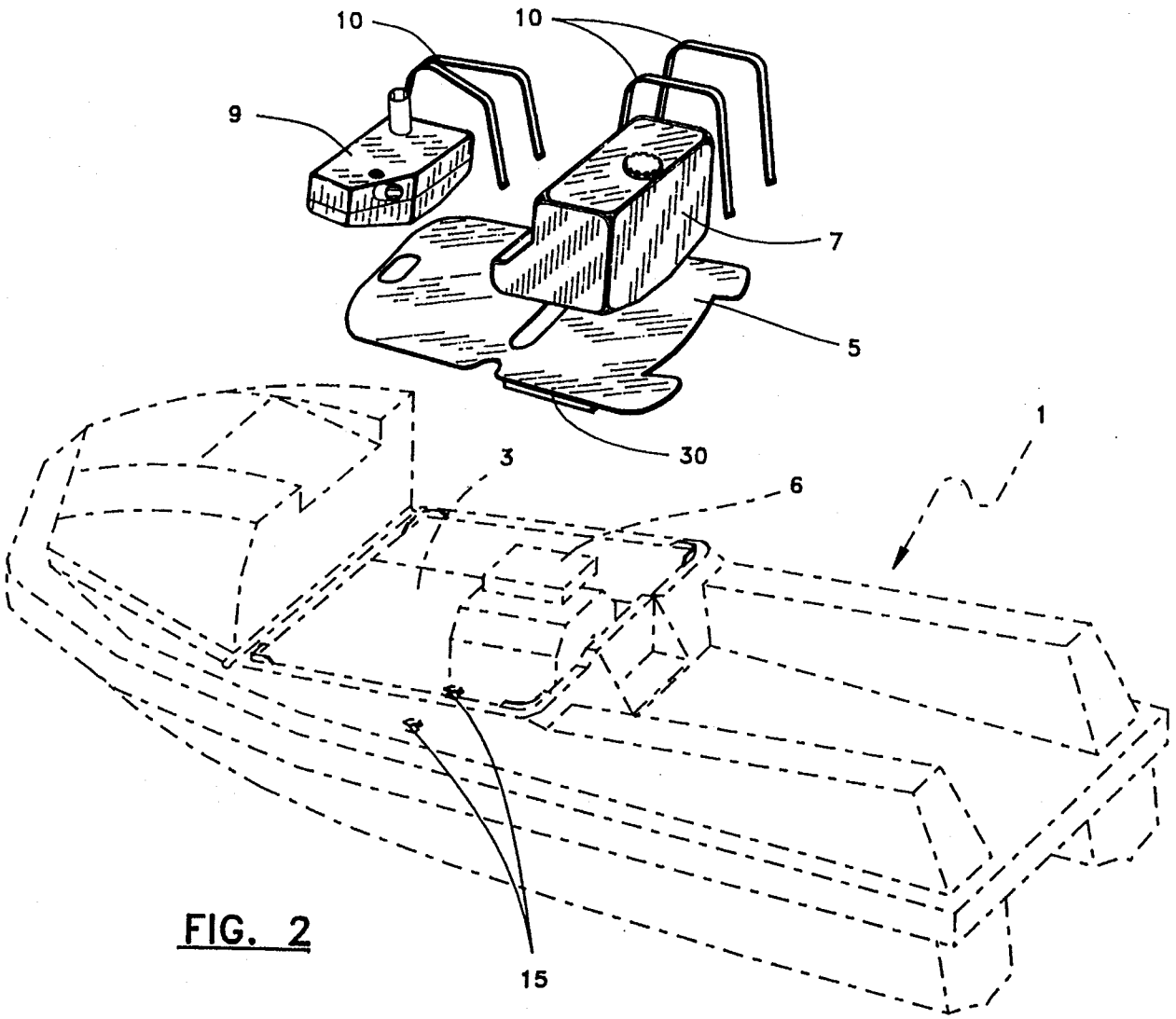
FIG. 2 is an exploded view, in perspective and with portions in phantom, showing the manner by which the protective mat of the present invention is placed between the inner engine compartment hull and the water box and fuel tank.

As can be more easily understood by reference to FIG. 2, protective mat 5 also has a pair of risers 30, 32 formed in the right and left sides of the mat 5. In a manner that is similar to the original neoprene pads of the Kawasaki Model 440 and 550 JetSkis®, the pair of risers 30, 32 provide a means for spacing the fuel tank 7 upwards and away from the bottom surface 3 of the JetSki® engine compartment 2. It can be appreciated that lifting the fuel tank 7 above the bottom surface 3 of the engine compartment 2 lessens the ability of the fuel tank 7 to vibrate against the bottom surface 3 as well as reducing the chance of damage by an obstacle that pierces the JetSki® hull.

As can be appreciated, the pair of risers 30, 32 are preferably permanently adhered to the under surface of the protective mat 5. At some point this may occur by forming the protective mat 5 and the risers 30, 32 in a single molding operation. Presently, such adherence is obtained through the use of a chemical bonding material, such as BF Goodrich A1404B glue. Of course, it is anticipated that any adhesive with the ability to bond the risers 30, 32 to the protective mat 5 can be used successfully with the present invention. Preferably, such an adhesive should have the ability to create a bond between the risers 30, 32 and the protective mat 5 that withstands environmental exposure to oil, gas, and sea water.

Figure 3:
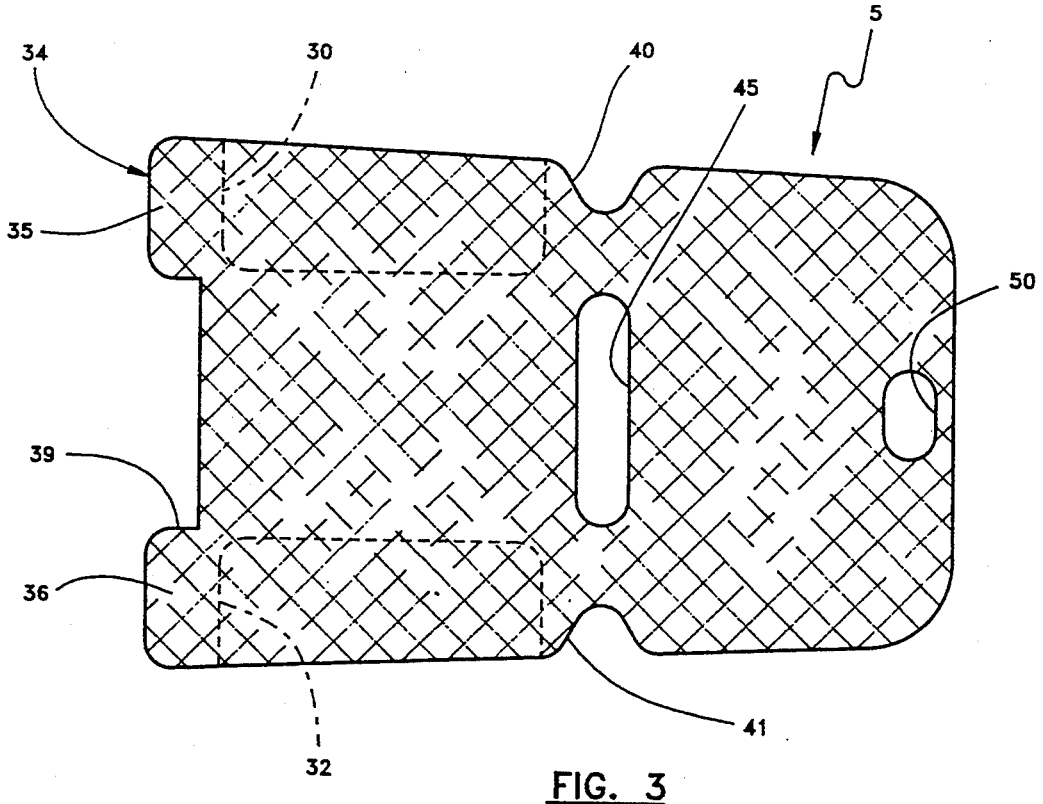
FIG. 3 is a top view illustrating one preferred embodiment of a protective mat in accordance with the present invention.

As shown in FIG. 3, the protective mat 5 for use with the Kawasaki Model 550 JetSki® has a rearward edge 34 having a pair of lateral flanges 35, 36, that in turn define a centrally-located, rectangular opening 39. As can be appreciated by reference to FIG. 1, the rectangular opening 39 has been designed to provide unobstructed access to the mounting brackets 15 on the bottom surface 3 of the engine compartment 2.

Laterally extending along the left and rights edges of the protective mat 5, beginning adjacent each of the flanges 35, 36 are the rectangular risers 30, 32. The risers 30, 32 extend along the left and right edges of the protective mat 5, from just adjacent the flanges 35, 36, to approximately the mid-point of the protective mat 5. The width of each of the risers 30, 32 is approximately one-fourth (¼) of the width of the entire protective mat 5. At approximately the mid-point of the protective mat 5, the left and right edges curve inward forming a pair of indentations 40, 41.

To a great extent, the perimeter curvature of the protective mat 5, such as the pair of indentations 40, 41, responds to the curves defining the bottom surface 3 of the engine compartment 2. An oblong cutout 45 is disposed between the indentations 40, 41, and at the center point of the protective mat 5, providing an opening through which the mounting straps 10 may be attached to their respective mounting brackets 15 on the bottom surface 3 of the engine compartment 2. Preferably, the mounting brackets 15 protrude upwards, through the oblong cutout 45 to permit an easy connection to the rubber straps 10. A front cutout 50 is disposed along the forward-most edge of the protective mat 5 and centrally located between the right and left sides. In a similar manner as did the oblong cutout 45, the front cutout 50 provides an opening through the protective mat 5 to the bottom surface 3 of the engine compartment 2. The front portions of the rubber straps 10 can thereby easily access their respective mounting brackets 15, which are attached to the bottom surface 3.

Figure 4:
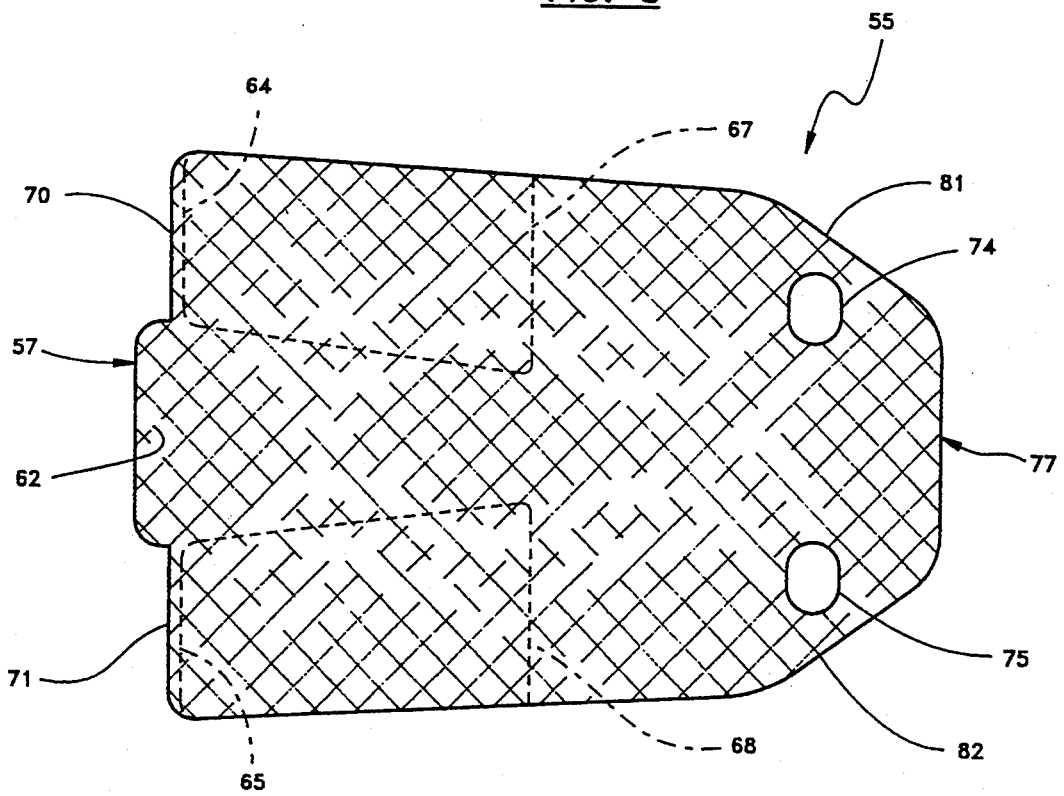
FIG. 4 is a top view illustrating an alternate embodiment of a protective mat in accordance with the present invention.

Alternate embodiments of the protective mat 5 of the present invention are also anticipated. For instance, a protective mat 55 designed for a Kawasaki Model 750SX JetSki ® is shown in FIG. 4. As can be appreciated, the mat for a Kawasaki Model 750SX is necessarily shaped differently from a protective mat for a Kawasaki Model 440, 550, or 650, due to differences in the shape of the engine compartments and the positioning of the gas tank and water box.

Centrally located along a rearward edge 57 of the Kawasaki Model 750SX protective mat 55 is a rearwardly protruding rectangular tongue 62. In a similar fashion to the protective mat 5 of the JetSki ® Model 550, a pair of risers 64, 65 are located along the right and left edges of the Model 750SX protective mat 55, and provide a means for lifting the fuel tank above the bottom surface of the engine compartment. The pair of risers 64, 65 have a pair of upper edges 67, 68 and a pair of lower edges 70, 71. Unlike the substantially rectangular risers 30, 32, to accommodate differences in the engine compartment, the Model 750SX risers 64, 65 are angled inward towards one another, whereby the upper edges 64, 65 are wider than the lower edges 62, 63.

To provide access to the mounting brackets (not shown in FIG. 4) used for attaching the water box and fuel tank (also not shown in FIG. 4), a pair of oval cutouts 74, 75 are formed adjacent a forward edge 77 of the protective mat 55. Further accommodations to the shape of the Model 750 engine compartment include a pair of inwardly-angled shoulders formed in the forward edge 77 of the protective mat 55.

Figure 5:
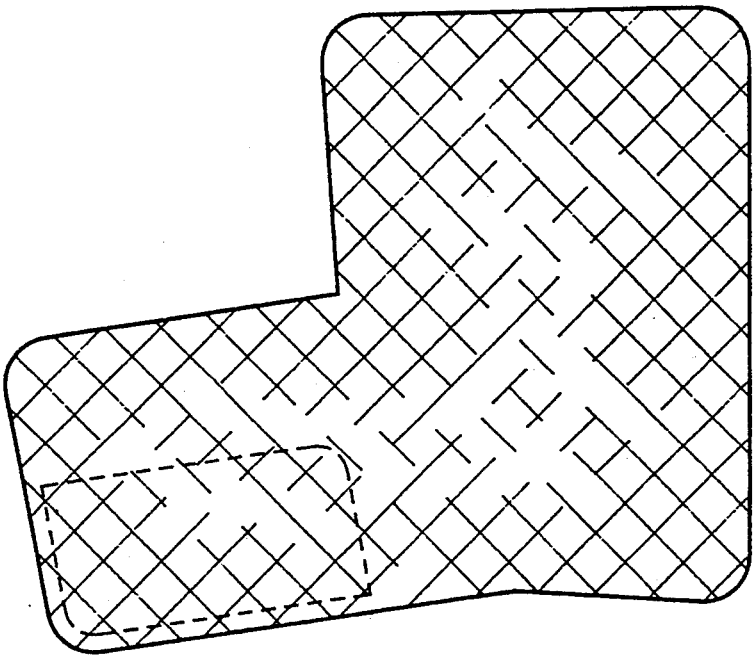
FIG. 5 is a top view illustrating an additional alternate embodiment of a protective mat in accordance with the present invention.

Another embodiment of the present invention is illustrated in FIG. 5 which shows a protective mat 79 for a Kawasaki 650X2 JetSki ®. The Kawasaki 650X2 protective mat 79 is "L" shaped, having a vertical portion 81 and a horizontal portion 83. The vertical portion 81 and horizontal portion 83 are joined at an obtuse angle 85. A single riser 87 is located in the forward left corner of the horizontal portion 83 providing a means for lifting the fuel tank up above the surface of the Kawasaki 650X2 JetSki ® hull.

While the embodiments of the protective mats described herein are most preferable, other embodiments are certainly anticipated. For instance, the shape of the risers could be altered by one of ordinary skill in the art but still keeping in the spirit of the present invention. For instance, other geometric shapes such as circles, ovals, and squares might be used in place of the preferred embodiment rectangular risers but still function in a similar manner. Similarly, the risers do not need to be glued onto the mat itself. As mentioned previously, one of ordinary skill in the art could produce a single piece mat wherein the risers were integrated into the mold and thereby formed a part of the mat itself. In addition, the cutouts that permit the mounting brackets to protrude through the protective mat could be of various shapes, while still performing a similar function. One of ordinary skill in the art could easily design many different-shaped cutouts that are anticipated to be within the scope of the present invention.

While I have disclosed exemplary structures to illustrate the principles of the present invention, it should be understood that I wish to embody within the scope of the patent warranted hereon, all such modifications as reasonable and properly come within the scope of my contribution to the art.

I claim:

1. In combination, a personal watercraft having a rigid hull with a forward portion adapted to retain an engine, a fuel tank, and a water box, said hull having a concave interior wall with two opposed molded flanges adapted to support said fuel tank;

a fuel tank mounted above said interior wall;

a flexible protective mat disposed between the fuel tank and the interior wall and conforming to said wall, said mat spanning the flanges and the entirety of the interior wall beneath the fuel tank.

2. The personal watercraft of claim 1, wherein said JetSki ® model is selected from the group consisting of: Kawasaki 440, Kawasaki 550, Kawasaki 550SX, Kawasaki 650X2 and Kawasaki 750SX.

3. The personal watercraft of claim 1 wherein said mat is less than one inch thick.

4. The personal watercraft of claim 3 wherein said mat is between 0.25 inches and 0.50 inches in thickness.

5. The personal watercraft of claim 1 wherein said mat comprises Koroseal.

6. The personal watercraft of claim 1 wherein said protective mat has risers permanently adhered to the surface of the protective mat, said risers being positioned to lift the underside of a personal watercraft fuel tank away from the bottom surface of the personal watercraft engine compartment.

* * * * *